United States Patent [19]

Russell et al.

[11] 3,989,910

[45] Nov. 2, 1976

[54] CONTROL DEVICE AND METHOD OF MAKING THE SAME

[75] Inventors: William J. Russell, Milford; Khiman K. Pursnani, Bridgeport; Rolf H. Ochsner, Trumbull, all of Conn.

[73] Assignee: Robertshaw Controls Company, Richmond, Va.

[22] Filed: Apr. 7, 1975

[21] Appl. No.: 565,615

[52] U.S. Cl. ..... 200/83 A; 200/83 S; 91/1; 73/407 R

[51] Int. Cl.[2] ..... H01H 35/34

[58] Field of Search ..... 200/153 T, 83 R, 83 A, 200/83 S, 83 SA, 83 W; 73/37, 269, 407 R; 91/1; 340/229, 231, 234, 240; 116/70, 124 L

[56] References Cited

UNITED STATES PATENTS

| | | | |
|---|---|---|---|
| 2,339,847 | 1/1944 | Ellison | 200/83 W |
| 2,500,457 | 3/1950 | Hess | 200/83 S |
| 2,790,044 | 4/1957 | Booth | 200/83 S |
| 3,005,887 | 10/1961 | Robson | 200/83 A |
| 3,007,017 | 10/1961 | Dwyer | 200/83 A |
| 3,573,409 | 4/1971 | Jeffrey | 200/83 W |
| 3,852,547 | 12/1974 | Dietz | 200/83 A |

*Primary Examiner*—Gerald P. Tolin
*Attorney, Agent, or Firm*—Candor, Candor & Tassone

[57] ABSTRACT

A control device having an actuator housing and a differential pressure responsive housing secured together so that a certain change in differential pressure in the pressure housing will cause a movable part thereof to move to a new certain position thereof and cause a lever arrangement in the actuator housing to operate an actuator therein. An actuating pin extends between the housings and has opposed ends respectively engaging the movable part of the pressure housing and the lever arrangement of the actuator housing to translate movement therebetween, the ends of the pin not being attached to the movable part and lever arrangement. A tubular bearing means is secured to the pressure housing and telescopically receives the actuating pin therethrough, the tubular bearing member being in fluid communication with the pressure housing so as to provide a fluid bearing for the actuating pin.

9 Claims, 2 Drawing Figures

CONTROL DEVICE AND METHOD OF MAKING THE SAME

It is well known that differential pressure operated control devices have been provided wherein each has an actuator housing and a differential pressure responsive housing secured together so that a certain change in the differential pressure in the pressure housing will cause a movable part thereof to move to a certain new position therein and cause lever means in the actuator housing to operate an actuator therein.

It is a feature of this invention to provide improved parts of such a control device or the like.

In particular, one feature of this invention is to provide an improved actuator pin arrangement for translating motion between the movable parts of the pressure housing and the lever means of the actuator housing.

Another feature of this invention is to provide an improved means for guiding movement of such an actuator pin.

Another feature of this invention is to provide an improved diaphragm arrangement for such control device.

Another object of this invention is to provide an improved lever arrangement for the actuator of such a control device or the like.

In particular, one embodiment of this invention provides a control device having an actuator housing and a differential pressure repsonsive housing secured together so that a certain change in differential pressure in the pressure housing will cause a movable part thereof to move to a certain new position therein and cause lever means in the actuator housing to operate an actuator therein. An actuating pin extends between the housings and has opposed ends respectively engaging the movable part of the pressure housing and the lever means of the actuator housing to translate motion therebetween. At least one of the housings has means carrying the actuating pin in such a manner that the ends thereof are not attached to the movable part and the lever means and are merely disposed in engagement therewith. The means carrying the actuator pin comprises a tubular bearing member telescopically receiving the actuating pin therethrough, the tubular bearing member being in fluid communication with the pressure housing and thereby providing a low friction fluid bearing for the actuating pin. The actuator comprises an electrical switch having a pivotally mounted lever extension for operating the same, the lever means of the actuator housing being engageable with the lever extension to pivot the same. The movable part of the pressure housing comprises a flexible diaphragm having a single corrugation so that wrinkles do not form in the diaphragm as the diaphragm moves relative to the pressure housing.

Accordingly, it is an object of this invention to provide a control device having one or more of the novel features set forth above or hereinafter shown or described.

Other objects, uses and advantages of this invention are apparent from a reading of this description which proceeds with reference to the accompanying drawings forming a part thereof and wherein.

Figure 1:
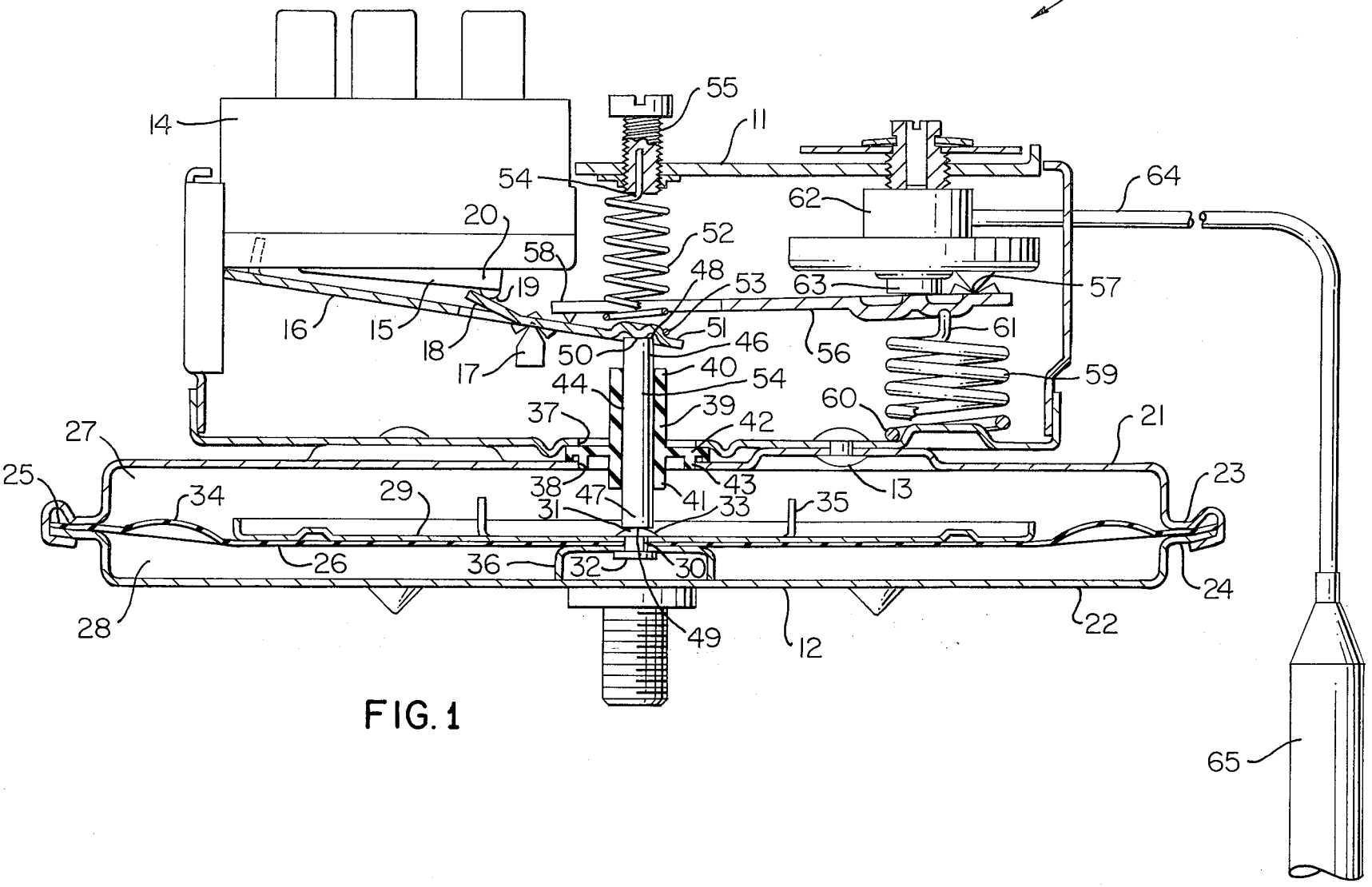
FIG. 1 is a cross-sectional view illustrating the improved control device of this invention.

While the various features of this invention are hereinafter described and illustrated as being particularly adapted for providing a defrost control device, it is to be understood that the various features of this invention can be utilized singly or in any combination thereof to provide a control device for other purposes as desired.

Therefore, this invention is not to be limited to only the embodiment illustrated in the drawings, because the drawings are merely utilized to illustrate one of the wide variety of the uses of this invention.

Figure 2:
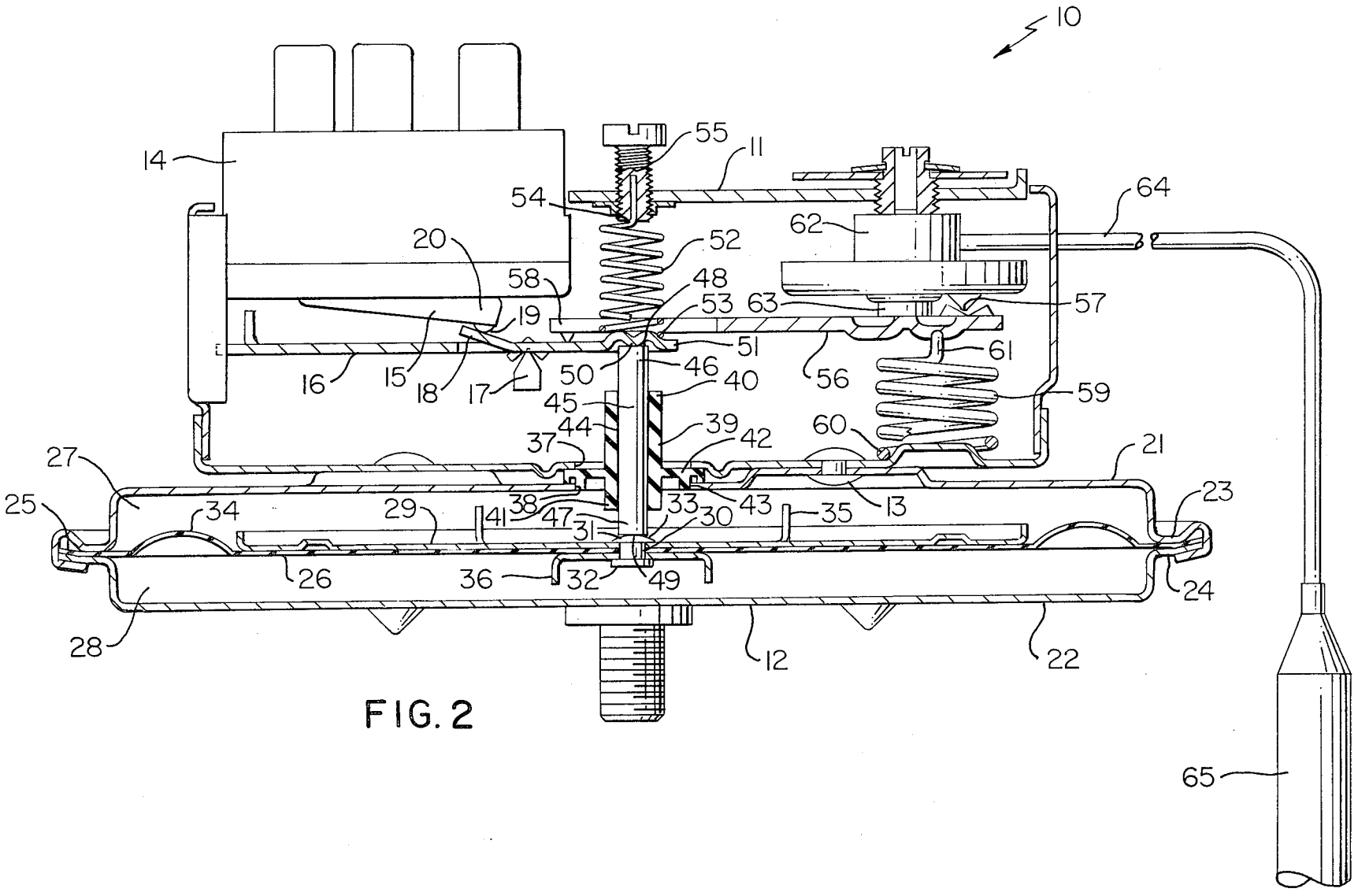
FIG. 2 is a view similar to FIG. 1 and illustrates the control device in another operating condition thereof.

Referring now to FIGS. 1 and 2, the improved control device of this invention is generally indicated by the reference numeral 10 and comprises an actuator housing means 11 and a differential pressure housing means 12 secured together by suitable fastening means 13 to provide a self-contained arrangement.

An electrical switch or actuator 14 is disposed in the actuator housing 11 and has a pivotally mounted lever extension 15 for operating the internal switch structure (not shown) from one condition thereof as illustrated in FIG. 1 to another condition thereof as illustrated in FIG. 2 when the lever extension 15 is pivoted from the position of FIG. 1 to the position of FIG. 2 by an initiate lever 16 that is pivotally mounted in the actuator housing 11 by a fulcrum means 17, the lever 16 having a bent-out tab 18 adapted to engage a convex surface 19 on the free end 20 of the lever extension 15 of the switch 14.

The differential pressure housing 12 comprises a pair of cup-shaped members 21 and 22 secured together at their open ends 23 and 24 by being suitably crimped together as illustrated and capturing an outer peripheral part 25 of a flexible diaphragm 26 therebetween whereby the flexible diaphragm 26 divides the differential pressure housing 12 into two chamber 27 and 28 which can be respectively interconnected by suitable conduit means to the pressure side and the suction side of a heat transfer coil in a manner well known in the art whereby the resulting pressure differential acting across the flexible diaphragm 26 will cause the flexible diaphragm 26 to move in the housing means 12 as will be apparent hereinafter.

The diaphragm 26 carries a smaller diameter cup-shaped rigidifying plate 29 that is fastened thereto by a rivet-like member 30 centrally disposed in the diaphragm 26 and having opposed enlarged ends 31 and 32 respectively disposed outboard of the stiffening plate 29 and diaphragm 26 as illustrated, the enlarged end 31 of the fastening member 30 being radiused to define an arcuate convex surface 33 for a purpose hereinafter described.

The stiffening plate 29 cooperates with the flexible diaphragm 26 in such a manner that a single corrugation or annular flute 34 is formed in the diaphragm 26 outboard of the stiffening plate 29 and inboard of the trapped outer peripheral portion 25 thereof as illustrated.

In this manner, it has been found that radial wrinkles do not tend to form in the diaphragm 26 as the same moves through its stroke in the housing means 12, such radial wrinkles normally causing a non-predictable change in the pressure required to cause a diaphragm to move through its stroke and such adverse situation is referred to as "oil canning". The diaphragm 26 can be made of relatively thin polyester film, such as 0.00075 of an inch thick, that does not change its pressure stroke characteristics with changes in ambient conditions.

If desired, the stiffening plate 29 can be provided with extensions 35 that are disposed in the chamber 27 and a cup member 36 that is disposed in the chamber 28 to limit movement of the diaphragm 26 respectively toward the housing member 21 and the housing member 22 by abutting thereagainst after the diaphragm 26 has been moved by the pressure differential to such a position.

The actuator housing 11 and differential pressure housing 12 have aligned openings 37 and 38 respectively formed therein with the opening 38 in its differential pressure housing 12 leading to the low pressure chamber 27 thereof.

A tubular bearing member 39 is disposed between the housing 11 and 12 so that opposed ends 40 and 41 thereof respectively project into the housing means 11 and 12 at the openings 37 and 38 thereof while an outwardly directed annular flange 42 of the tubular bearing member 39 extends between the housings 11 and 12 to close the openings 37 and 38 thereof, the annular flange 42 having a depending cylindrical portion 43 suitably fastened to and sealing against the opening 38 of the housing member 21 to completely seal close the opening 38 except at a central cylindrical passage 44 passing through the bearing member 39 for a purpose hereinafter described.

An actuating pin 45 is telescopically disposed in the central passage 44 of the tubular bearing member 40 and has opposed ends 46 and 47 respectively extending beyond the opposed ends 40 and 41 of the tubular bearing member 40 to respectively engage against the lever 16 and the diaphragm fastener 30 to translate motion therebetween as will be apparent hereinafter.

The opposed ends 46 and 47 of the actuating pin 45 are respectively provided with flat end surfaces 48 and 49 with the flat end surface 48 engaging against a radiused convex extension 50 on the end 51 of the lever 16 while the flat end surface 49 of the actuating pin 45 is disposed in engagement with the radiused convex surface 33 of the fastening member 30 of the diaphragm 26 as illustrated.

In this manner, the actuating pin 45 is not attached to the diaphragm 26 and its associated parts and is not confined to a specific point on the initiate lever 16 whereby the unattached pin 45 eliminates all concentricity problems during assembly of the control device 10 and thus eliminates friction and also force changing angular opeation of the diaphragm 26 through its stroke. The flat end surfaces 48 and 49 of the actuating pin 45 working on the spherical radiused boss 50 of the initiate lever 16 and the oval head rivet 30 of the diaphragm 26 prevent any change in lever ratio thus keeping the stroke-pressure parameters of the control device 10 constant.

Since the end 41 of the tubular member 40 is in fluid communication with the low pressure chamber 27 of the differential pressure housing 12, it can be seen that a certain fluid leakage will occur between the passage 44 of the tubular bearing member 40 and the actuating pin 45 at a controlled rate so that, in effect, a low friction fluid bearing is provided for the actuating pin 45 in guiding its axial movement in the passage 44 of the tubular bearing member 40 when the same translates motion of the diaphragm 26 to the initiate lever 16.

Thus, it can be seen that the tubular bearing member 40 is a multi-purpose component as the same provides a guide for the actuating pin 45, a closure means for the low pressure chamber 27 with the low control leakage therefrom and a very low friction fluid bearing for the actuating pin 45. It is believed that all of these improvements reduce the pressure required to cause the diaphragm 26 to move through its stroke as will be apparent hereinafter.

The end 51 of the lever 16 is maintained in engagement with the end surface 48 of the actuating pin 45 by a range spring 52 having one end 53 bearing against the end 51 of the lever 16 and another end 54 fastened to a threaded adjusting member 55 threadedly carried by the housing means 11 as illustrated.

In addition, another lever 56 is pivotally mounted in the actuator housing 11 to pivot about a pivot point 57 whereby a bifurcated end 58 thereof is adapted to engage against the end 51 of the lever 16 while receiving the range spring 52 therethrough. A compression spring 59 is disposed in the actuator housing 11 and has one end 60 bearing against the housing means 11 while the other end 61 thereof bears against the lever 56 to hold the same against the fulcrum point 57, the spring 50 also providing for the overshoot movement of the lever 56 due to extra movement of the power element 62 during high summer temperatures that could damage the lever system or diaphragm. A fluid operated power element 62 is carried in the actuator housing 11 and has a movable part 63 engaging against the lever 56 to the left of the fulcrum point 57 as illustrated in the drawings whereby exapnsion of the power element 62 moves the movable part 63 downwardly to thereby cause the bifurcated end 58 of the lever 56 to pivot in a counterclockwise direction and thereby tend to move the intial lever 16 and actuating pin 45 downwardly with a certain force and as the power element 62 tends to collapse, the same reduces the force of the lever 56 tending to act downwardly on the end 51 of the lever 16 and actuating pin 45 as will be apparent hereinafter.

The power element 62 is interconnected by a suitable capillary tube 64 to a temperature sensing bulb 65 whereby the fluid in the bulb 65 will expand upon an increase in sensed temperature thereof to tend to move the movable wall 63 of the power element 62 downwardly and will tend to cause the wall 63 to move upwardly when the fluid in the bulb 65 senses a decrease in temperature.

From the above, it can be seen that the control device 10 can be formed from a relatively few parts easily assembled together to provide a control device that is adapted to operate in a manner now to be described.

When the heat transfer coil (not shown) of the system is "iced up" the temperature being sensed by the bulb 65 is low whereby the terminnte lever 56 of the control device 10 has been rotated in a clockwise direction by the spring 59 as the power element 62 is in a collapsed condition. Thus, the terminate lever 56 is out of the way of the initiate lever 16. Also, with the coil iced up, a pressure differential exists across the coil that causes a pressure differential across the diaphragm 26 and thereby causes the diaphragm 26 to move upwardly in the drawings. Such upward movement of the diaphragm 26 causes the initiate lever 16 to pivot in a counterclockwise direction as illustrated in FIG. 2 to permit the switch extension 15 to move out relative to the switch 14 whereby the switch 14 initiates a defrost or deice cycle to free the coil of its iced up condition.

This action of the switch 14 for the deice cycle also turns off the fan to the coil and thereby causes the pressure differential across the coil to fall to zero and thus across the diaphragm 26 whereby the diaphragm 26 moves downwardly in the drawings and the pin 45 thereby moves away from the initiate lever 16.

When the ice melts at the heat transfer coil, the temperature of the coil rises and this rising temperature is sensed by the bulb 65 whereby the sensed rising temperature causes the power element 62 to expand and move the terminate lever 56 in a counterclockwise direction. Such counterclockwise movement of the terminate lever 56 causes the end 58 thereof to engage the initiate lever 16 to rotate the initiate lever 16 in a clockwise direction thereof back to the position illustrated in FIG. 1 whereby the lever extension 15 of the switch 14 is again pushed in to cause the switch 14 to terminate the deice cycle and turn on the fan to the heat transfer coil.

Thus, it can be seen that pressure initiates the deice cycle while temperature terminates the deice cycle whereby lever 16 is an initiate lever and lever 56 is a terminate lever.

Therefore, it can be seen that as the diaphragm 26 moves upwardly in the differential pressure housing 12, the same causes a change in the operating condition of the electrical switch 14 with such movement of the diaphragm 26 being translated by the pin 45 to the initiate lever 16 and, thus, from the lever 16 to the lever extension 15 of the switch 14.

It is believed that the contact switching mechanism for the switch 14 is improved by the means of the friction free pivoted operating lever extension 15 being utilized in place of the conventional push button normally utilized for actuating a switch construction. Lever extension 15 also changes the lever ratio from that of a push button operation so that a lower force is required to operate the switch 14 of this invention. This, in turn, permits the use of a lower rate range spring 52.

It is also belived that the elimination of the variables, switch push button friction, diaphragm rate due to radial wrinkles, concentricity binding, and rate of old rubber pin-sealing diaphragm, provide the control device 10 with a high degree of repeatability. This coupled with the lower rate system permits operation of the control device 10 at very low pressures. Thus, it can be seen that the above described control device 10 is not sensitive to ambient temperatures, has repeatability within 0.01 inch W.C., has wide range of operating pressures from 0.10 inch W.C. to 1.0 inch W.C., has a nonwrinkling highly flexible diaphragm, has a friction free fluid bearing for the actuating pin, has controlled leakage seal and guide for the actuating pin, eliminates concentricity problems, has low cost simplified parts and assembly and since the lever pivots and operating contacts are in line, the control device 10 eliminates sliding friction at the contact points on the levers.

Thus, it can be seen that this invention provides an improved differential pressure operated control device.

While the form now preferred as been described and illustrated as required by the Patent Statute, it is to be understood that other forms can be utilized and still come within the scope of the appended claims.

What is claimed is:

1. In a control device having an actuator housing and a differential pressure responsive housing secured together so that a certain change in differential pressure in said pressure housing will cause a part thereof to move to a certain new position therein and cause lever means in said actuator housing to operate an actuator therein, the improvement comprising a tubular bearing member disposed between said housings and being carried by said pressure housing, said housings having aligned openings respectively receiving opposed ends of said tubular member whereby said opposed ends respectively project into said housings, said tubular member closing said openings of said housings, and an actuating pin telescoped in said tubular bearing member and having opposed ends extending from said tubular bearing member and engaging said movable part and said lever means to translate motion therebetween, said tubular bearing member being in fluid communication with said pressure housing and thereby providing a fluid bearing for said actuating pin.

2. In a control device as set forth in claim 1, said tubular member sealing said opening of said pressure housing except for the area between said pin and said tubular member.

3. In a control device as set forth in claim 1, said ends of said pin only being in engagement with said movable part and said lever means and not attached thereto.

4. In a control device as set forth in claim 3, one of said lever means and its respective pin end being substantially flat while the other is radiused in the engagement area thereof.

5. In a control device as set forth in claim 3, one of said movable part and its respective pin end being substantially flat while the other is radiused in the engagement area thereof.

6. In a control device as set forth in claim 3, said ends of said pin being flat and said movable part and said lever means respectively being radiused in the pin engagement areas thereof.

7. In a control device as set forth in claim 1, said movable part of said pressure housing comprising a flexible diaphragm having a single corrugation so that wrinkles do not form therein as said diaphragm moves relative to said pressure housing.

8. In a control device as set forth in claim 1, said actuator housing containing electrical switch having a pivotally mounted lever extension for operating the same, said lever means being engageable with said lever extension to pivot

9. In a control device as set forth in claim 1, said tubular bearing member having an annular flange intermediate said opposed ends thereof, said flange being disposed between said housings and closing said openings thereof.

* * * * *